US005779259A

United States Patent [19]

Lin

[11] Patent Number: 5,779,259

[45] Date of Patent: Jul. 14, 1998

[54] TOE-STRAP OF A SKI BOOT BINDING

[76] Inventor: Jack Lin, 3 Edwards Pl., Ellenville, N.Y. 12428

[21] Appl. No.: 663,974

[22] Filed: Jun. 14, 1996

[51] Int. Cl.[6] ..... A43C 11/14

[52] U.S. Cl. ..... 280/623; 24/68 SK; 24/70 SK

[58] Field of Search ..... 280/14.2, 621, 280/623, 11.3; 24/68 SK, 68 B, 68 CD, 70 SK

[56] References Cited

U.S. PATENT DOCUMENTS

| | | | |
|---|---|---|---|
| 2,802,248 | 8/1957 | Wallace | 24/68 B |
| 3,662,435 | 5/1972 | Allsop | 24/70 SK |
| 4,547,980 | 10/1985 | Olivieri | 24/70 SK |
| 5,172,454 | 12/1992 | Martignago | 24/68 SK |
| 5,416,952 | 5/1995 | Dodge | 24/68 SK |
| 5,606,779 | 3/1997 | Lu | 24/68 SK |
| 5,642,555 | 7/1997 | Lin | 24/70 SK |

*Primary Examiner*—Thomas J. Brahan
*Attorney, Agent, or Firm*—Jones, Tullar & Cooper, P.C.

[57] ABSTRACT

A toe-strap including a toothed strap and a plain strap respectively connected to the ski boot binding of a ski at two opposite sides and a buckle fixedly fastened to the plain strap and adapted for securing the toothed strap to the plain strap to hold down a ski boot in the ski boot binding, the buckle including a base frame fixed to the plain strap, a handle pivoted to one end of the base frame, a baffle plate pivoted to the base frame and retained in engagement with the toothed strap by a torsional spring, a front push plate pivoted to the handle and forced downward by a torsional spring and controlled by the handle to push the free end of the toothed strap forwards, and a retainer plate pivoted to the handle remove from the front push plate and forced downward by a torsional spring into engagement with the base frame to lock the handle in the close position.

1 Claim, 5 Drawing Sheets

TOE-STRAP OF A SKI BOOT BINDING

BACKGROUND OF THE INVENTION

The present invention relates to ski boot bindings, and relates more particularly to the toe-strap of the ski boot binding of a ski.

A variety of skis have been disclosed for sliding over snow, and have appeared on the market. A ski is generally equipped with a ski boot binding with a toe-strap for securing the ski boot to the ski. The toe-strap comprises a buckle fixedly secured to the base of the ski boot binding at one side and a strap fixedly secured to the base of the ski boot binding at an opposite side. When fastening the ski boot, the free end of the strap is inserted through the buckle, and then the swivel pin of the buckle is inserted into one of the longitudinal series of through holes in the free end of the strap to secure the free end of the strap to the buckle. The through holes of the strap tend to be damaged by the swivel pin during skiing. Furthermore, adjusting the tightness of the toe-strap is not an easy job because the swivel pin must be disconnected from the through holes of the strap and then inserted therein again after an adjustment.

SUMMARY OF THE INVENTION

The present invention has been accomplished to provide a toe-strap which eliminates the aforesaid drawbacks. It is one object of the present invention to provide a toe-strap for a ski boot binding which can be conveniently adjusted to the desired tightness. It is another object of the present invention to provide a toe-strap for a ski boot binding which is applicable for a fine adjustment. It is still another object of the present invention to provide a toe-strap for a ski boot binding which firmly secures the skit boot in place when fastened up. According to the preferred embodiment of the present invention, the toe-strap comprises a toothed strap and a plain strap respectively connected to the ski boot binding of a ski at two opposite sides and a buckle fixedly fastened to the plain strap and adapted for securing the toothed strap to the plain strap to hold down a ski boot in the ski boot binding, the buckle including a base frame fixed to the plain strap, a handle pivoted to one end of the base frame, a baffle plate pivoted to the base frame and retained in engagement with the toothed strap by a torsional spring, a front push plate pivoted to the handle and forced downward by a torsional spring and controlled by the handle to push the free end of the toothed strap forwards, and a retainer plate pivoted to the handle remove from the front push plate and forced downward by a torsional spring into engagement with the base frame to lock the handle in the close position.

DETAILED DESCRIPTION OF THE PREFERRED EMBODIMENT

Figure 1:
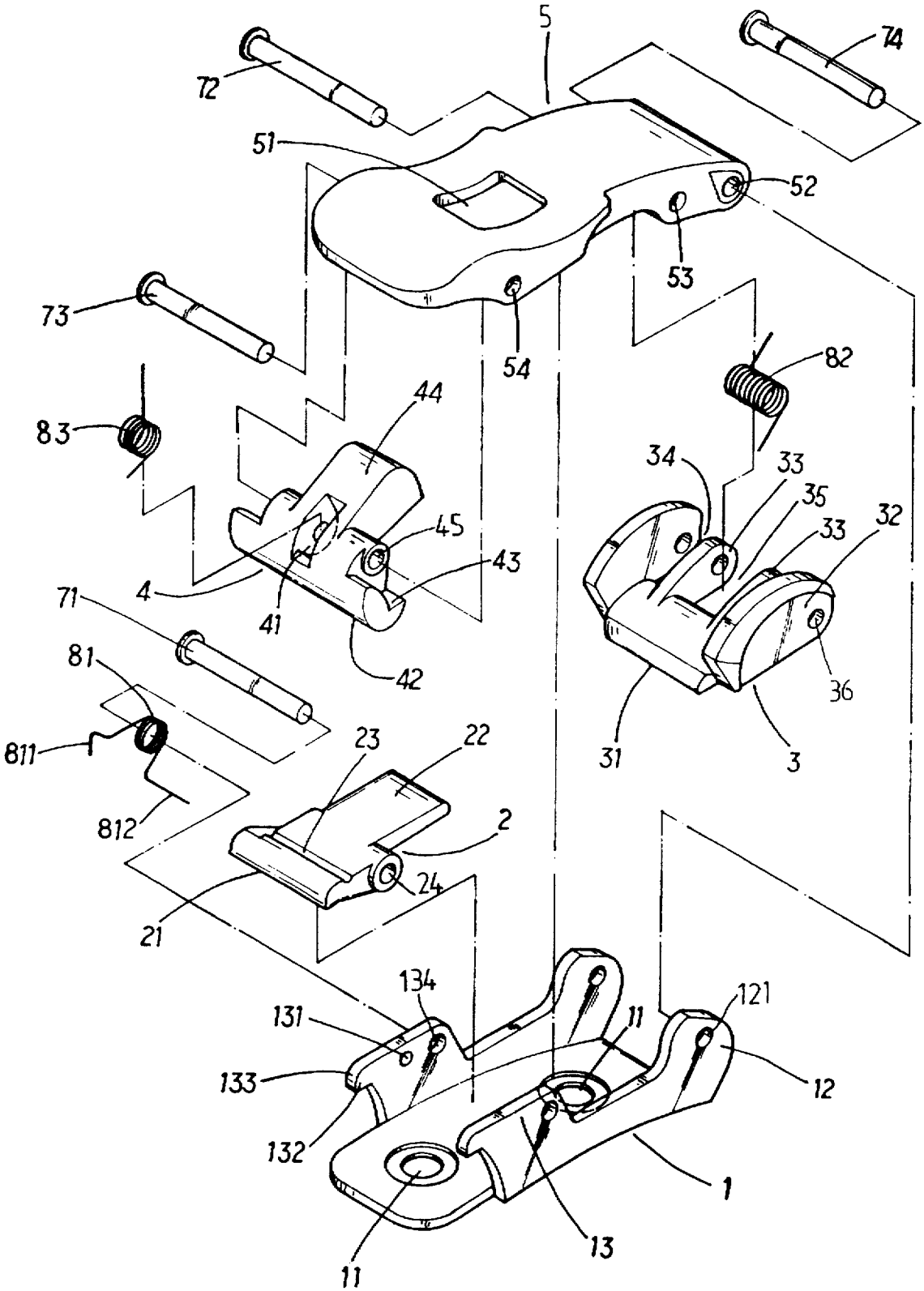
FIG. 1 is an exploded view of the buckle of a toe-strap according to the preferred embodiment of the present invention.
Figure 2:
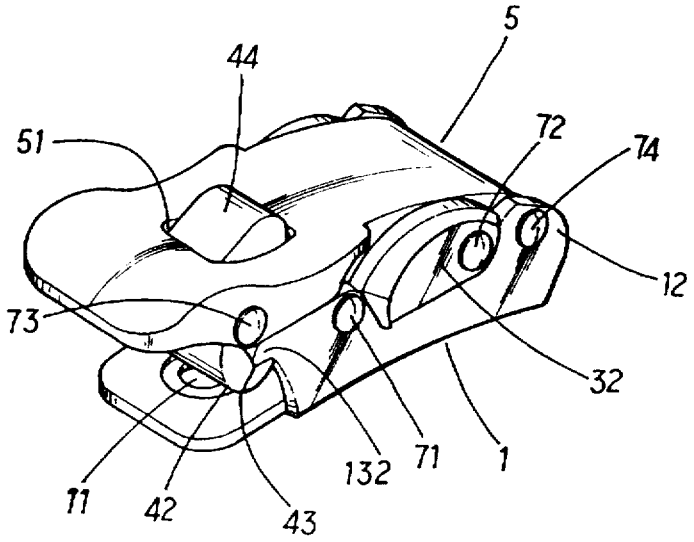
FIG. 2 is an elevational view showing the buckle of the preferred embodiment of the present invention assembled.
Figure 3:
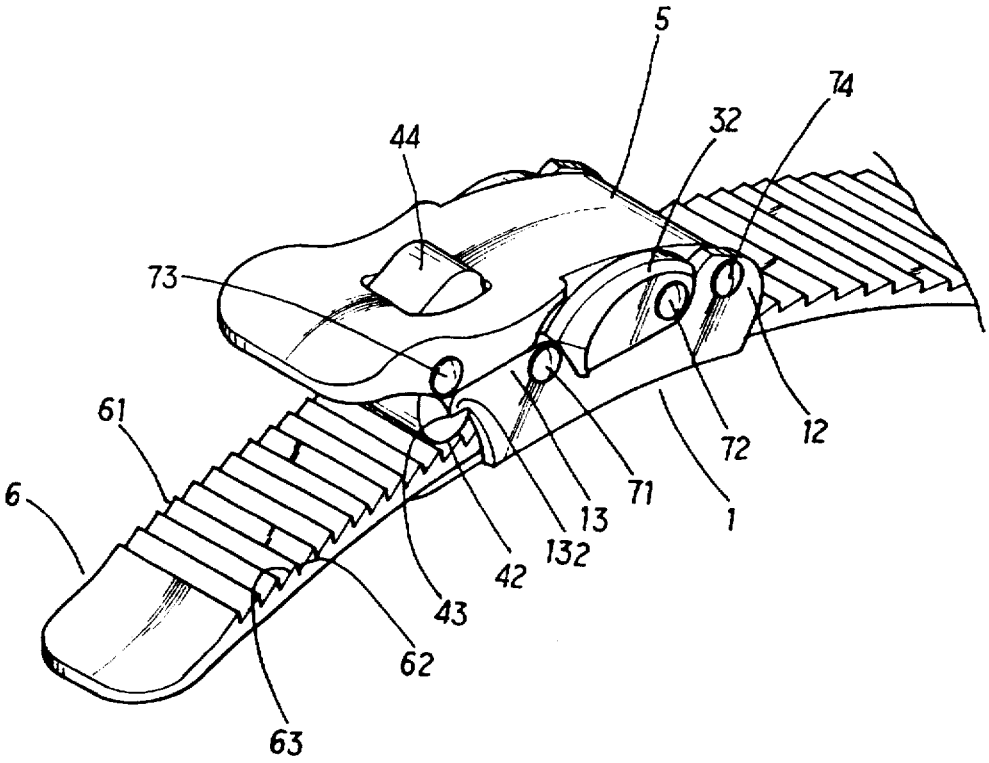
FIG. 3 is another elevational view of the present invention, showing the first strap fastened to the buckle.
Figure 4:
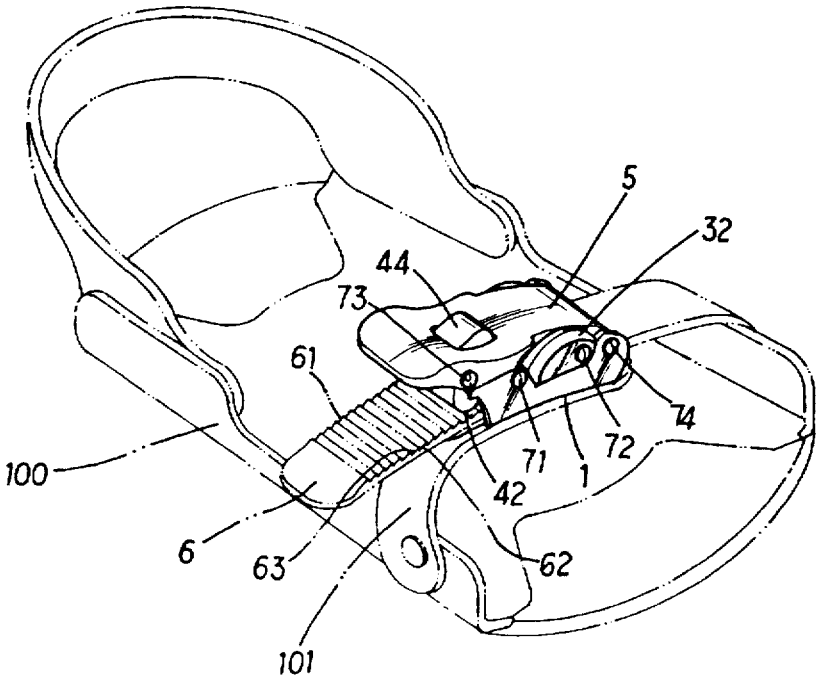
FIG. 4 is an applied view of the present invention, showing the toe-strap installed in ski boot binding.

Referring to FIGS. 1, 2, 3, and 4, a toe-strap of a ski boot binding in accordance with the present invention is comprised of a buckle, a first strap 6, and a second strap 101. The first strap 6 and the second strap 101 are respectively and fixedly secured to the ski boot binding 100 at two opposite sides. The buckle is adapted for joining the free ends of the first strap 6 and the second strap 101. FIG. 1 is an exploded view of the buckle. FIG. 2 is an elevational view showing the buckle assembled. As illustrated, the buckle is comprised of a base frame 1, a rear baffle plate 2, a front push plate 3, a retainer plate 4, and a handle 5. The base frame 1 comprises two round holes 11 near two opposite ends, a pair of first upright lugs 12 and a pair of second upright lugs 13 respectively raised from two opposite sides near two opposite ends. Each of the second upright lugs 13 has a nose 132 with a smoothly curved top edge 133. One of the second upright lugs 13 has a hook hole 131. The rear baffle plate 2 comprises transverse stop face 21 at one end, a stop plate 22 at an opposite end, and a transverse groove 23 at the top side near the transverse stop face 21. A first torsional spring 81 is provided, having a first end 811 fastened to the hook hole 131 of the base frame 1 and a second end fastened to the transverse groove 23 of the rear baffle plate 2. The front push plate 3 comprises a transverse push face 31 at one end, two upright side walls 32 at two opposite lateral sides, two backward lugs 33 perpendicularly extending from the transverse push face 31 and equally spaced between the upright side walls 32. Each upright side wall 32 defines with the adjacent backward lugs 33 a space 34. The backward lugs 33 define a space 35 therebetween adapted for receiving a second torsional spring 82. The retainer plate 4 comprises a top recessed hole 41 which receives a third torsional spring 83, a smoothly curved face 42 at one end, a press knob 44 at an opposite end, and two pawls 43 at two opposite sides of the smoothly curved face 42. The handle 5 comprises a top opening 51, a first transverse pivot hole 52 near one end, a second transverse pivot hole 54 near an opposite end, and a third transverse pivot hole 53 spaced between the first transverse pivot hole 52 and the second transverse pivot hole 54 but relatively closer to the first transverse pivot hole 52. The handle 5 has a hollow structure so that an open space is defined at the bottom adapted for receiving the retainer plate 4 and a part of the front push plate 3. The first strap 6 has a plurality of transverse teeth 61 longitudinally spaced along the top side. The transverse teeth 61 slope in one direction, each comprised of a retaining face 62 and a sliding face 63 that meet at the top.

Figure 5:
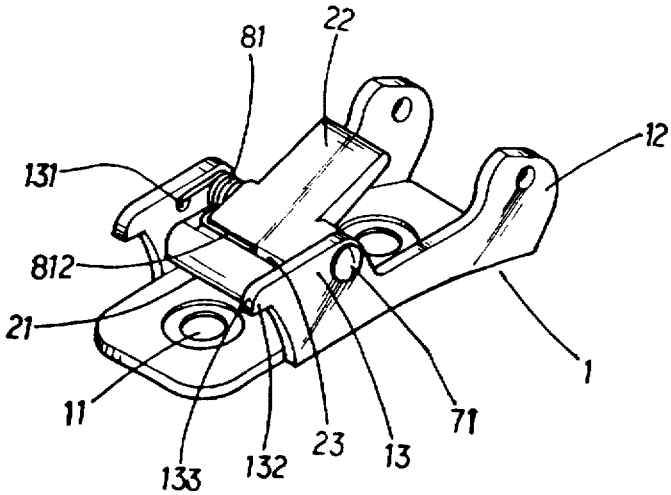
FIG. 5 is an elevational view of a part of the buckle of the preferred embodiment of the present invention, showing the base frame, the rear baffle plate, the first pivot, and the first torsional spring assembled.
Figure 6:
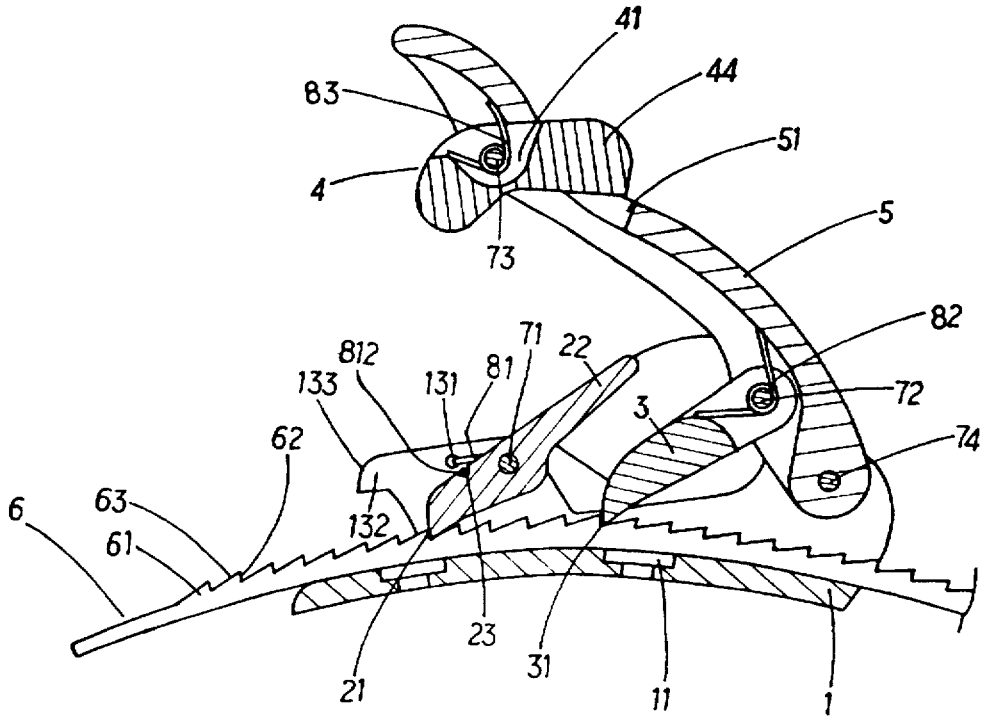
FIG. 6 is a sectional view of the toe-strap of the preferred embodiment of the present invention.

The assembly process of the present invention is outlined hereinafter with reference to Figures from 1 to 6. The base frame 1 is fixedly secured to the second strap 101 of the ski boot binding 100 by fastening the round holes 11 to the second strap 101 by fastening elements for example rivets (see FIG. 4). Then, a first pivot 71 is inserted through respective pivot holes 134 in the second upright lugs 13 of the base frame 1, the first torsional spring 81, and a transverse pivot hole 24 in the middle of the baffle plate 2, permitting the first torsional spring 81 to be retained between one second upright lug 13 of the base frame 1 and the baffle plate 2 and the baffle plate 2 to be turned about the first pivot 71 between the second upright lugs 13 of the base frame 1. When the first torsional spring 81 is mounted around the first pivot 71, the first end 811 and second end 812 are respectively fastened to the hook hole 131 of the base frame 1 and the transverse groove 23 of the rear baffle plate 2 (see FIG. 5). Because of the spring force of the first torsional spring 81, the transverse stop face 21 of the baffle plate 2 is constantly forced down. Then, a second pivot 72 is inserted through the third pivot hole 53 of the handle 5, respective pivot holes 36 on the upright side walls 32 and backward lugs 33 of the front push plate 3, and the second torsional spring 82, permitting the second torsional spring 82 to be turned about the second pivot 72 within the space 35 between the backward lugs 33 and the handle 5 to be turned about the second pivot 72 between the upright side walls 32 of the front push plate 3. When the handle 5 and the front push plate 3 are assembled, the two opposite ends of the second torsional spring 82 are respectively stopped against the bottom side of the handle 5 and the top side of the front push plate 3. Because of the spring force of the second torsional spring 82, the push face 31 of the front push plate 3 is constantly forced down (see FIG. 6). Then, the press knob 44 of the retainer plate 4 is inserted into the top opening 51 of the handle 5 from the bottom, permitting the two opposite ends of the third torsional spring 83 to be respectively stopped against the bottom side of the handle 5 and the top side of the retainer plate 4. Then, a third pivot 73 is inserted the second transverse pivot hole 54 of the handle 5, a transverse pivot hole 45 in the middle of the retainer plate 4 which intersecting the top recessed hole 41, and the third torsional spring 83. Because of the spring force of the third torsional spring 83, the press knob 44 of the retainer plate 4 is constantly retained in the top opening 51 of the handle 5. Finally, a fourth pivot 74 is inserted through the first transverse pivot hole 52 of the handle 5 and respective pivot holes 121 in the first upright lugs 12 of the base frame 1 to pivotably connect the handle 5 and the base frame 1 together.

Figure 7:
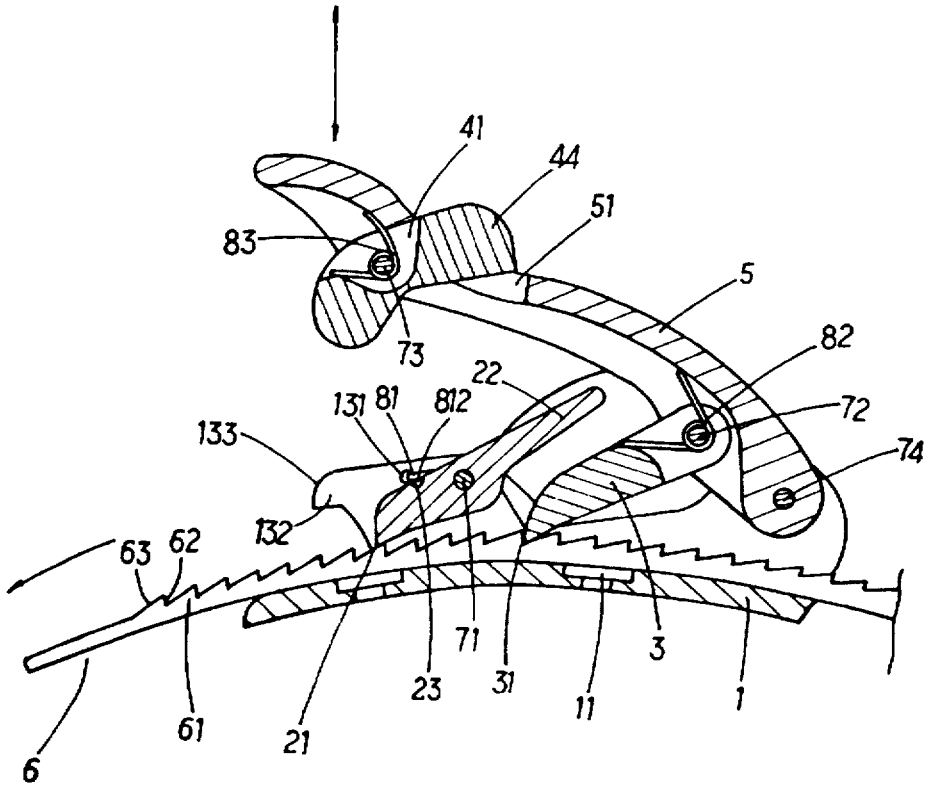
FIG. 7 is similar to FIG. 6 but showing the handle turned up and down and the first strap pushed forwards.
Figure 8:
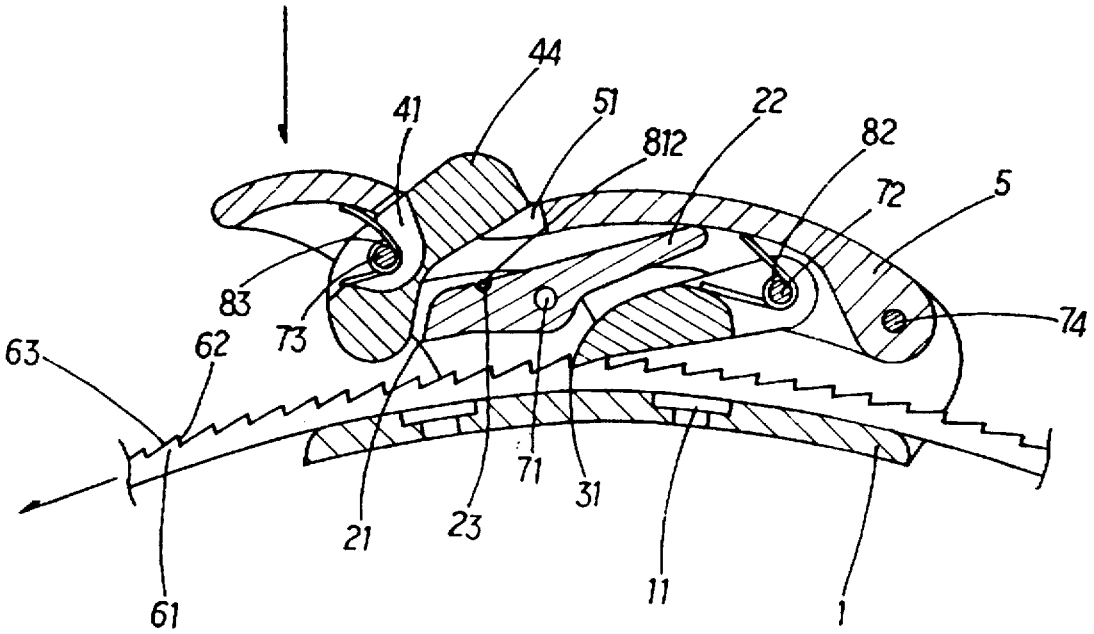
FIG. 8 is similar to FIG. 6 but showing the handle closed.
Figure 9:
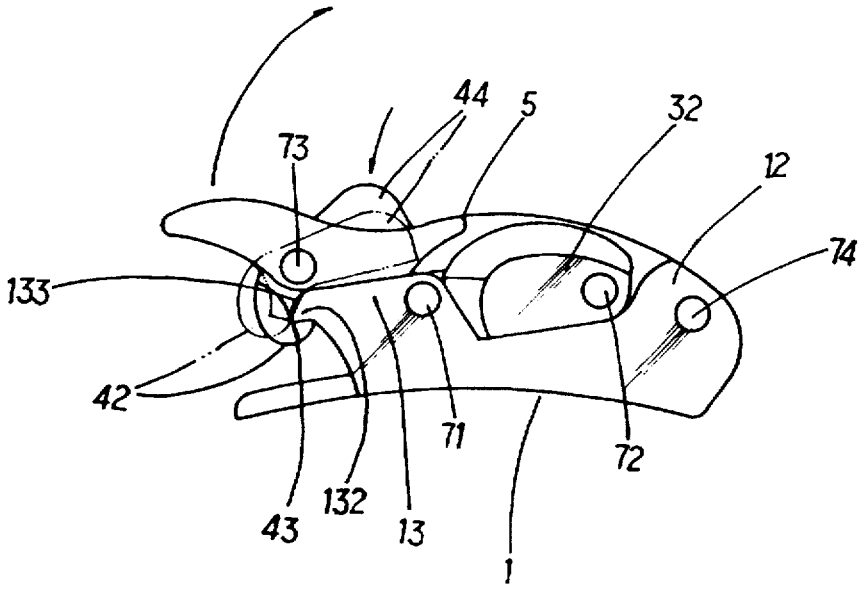
FIG. 9 is side plain view of FIG. 2 in an enlarged scale, showing the push knob of the retainer plate pressed down.

Referring to Figures from 7 to 9 and FIG. 4 again, when the skid boot is put in the ski boot binding 100, the free end of the first strap 6 is inserted through the gap between the base frame 1 and the handle 5 beneath the front push plate 3 and the baffle plate 2. Because the transverse teeth 61 of the first strap 6 slope in one direction, the first strap 6 can be smoothly inserted forwards. If the first strap 6 is pushed backwards, the transverse stop face 21 of the rear baffle plate 2 will be forced into engagement with the retaining face 62 of one of the transverse teeth 61 of the first strap 6 to stop the first strap 6 from backward movement (see FIG. 6). When the handle 5 is turned downwards about the fourth pivot 74 (see FIG. 7), the push plate 3 is forced to turn about the second pivot 72, and at the same time, the push face 31 is forced to push the retaining face 62 of one transverse tooth 61 forwards at a distance equal to one transverse tooth 61. When the handle 5 is turned upwards about the fourth pivot 74, the push face 31 of the front push plate 3 is moved backwards over the sliding face 63 of a next transverse tooth 61 into engagement with the retaining face 62 therefore for a next forward push, and at the same time, the transverse stop face 21 of the baffle plate 2 is moved from the retaining face 62 of one transverse tooth 61 to another to prohibit the first strap 6 from backward movement. After adjustment, the handle 5 is turned downwards about the fourth pivot 74 to the close position in which the smoothly curved face 42 of the retainer plate 4 is forced to pass through the smoothly curved top edges 133 of the noses 132 of the base frame 1, thereby causing the pawls 43 to be forced into engagement with the noses 132 of the base frame 1 (see FIGS. 8 and 9). When the handle 5 is closed, the stop plate 22 of the baffle plate 2 is forced down by the handle 5 to push the transverse stop face 21 away from the retaining face 62 of the corresponding transverse tooth 61 of the first strap 6, however the push face 31 of the front push plate 3 is still maintained in engagement with the retaining face 62 of one transverse tooth 61 of the first strap 6, and therefore the first strap 6 is still prohibited from backward movement (see FIG. 8). When the press knob 44 of the retainer plate 4 is pressed down, the pawls 43 are forced away from the noses 132 of the base frame 1, permitting the handle 5 to be turned upwards from the close position to the open position in which the stop plate 22 of the baffle plate 2 is forced down by the handle 5 to push the transverse stop face 21 away from the retaining face 62 of the corresponding transverse tooth 61 of the first strap 6, and therefore the first strap 6 can be pulled backwards and released from the buckle.

While only one embodiment of the present invention has been shown and described, it will be understood that various modifications and changes could be made thereunto without departing from the spirit and scope of the invention disclosed.

What the invention claimed is:

1. The toe-strap comprising a first strap having a fixed end fixedly secured to the ski boot binding of a ski at one side and a free end, a second strap having a fixed end fixedly secured to the ski boot binding of said ski at an opposite side and a free end, and a buckle fixedly secured to the free end of said second strap and adapted for securing the free end of said first strap to hold down a ski boot in said ski boot binding, the free end of said first strap having a longitudinal series of transverse teeth sloping in the direction from the free end of said first strap toward the fixed end thereof, wherein said buckle comprises:

a base frame, said base frame comprising a pair of first upright lugs and a pair of second upright lugs respectively raised from two opposite sides, each of said second upright lugs having a nose with a smoothly curved top edge, one of said second upright lugs having a hook hole;

a first pivot connected between the second upright lugs of said base frame;

a rear baffle plate turned about said first pivot, said rear baffle plate having transverse stop face at one end forced into engagement with the transverse teeth of said first strap, a stop plate at an opposite end, and a transverse groove at a top side thereof near said transverse stop face;

a first torsional spring mounted around said first pivot between said rear baffle plate and one second upright lug of said base frame, having a first end fastened to the hook hole of said base frame and a second end fastened to the transverse groove of said rear baffle plate to force the transverse stop face into engagement with the transverse teeth of said first strap;

a hollow handle coupled to the first upright lugs of said base frame, said handle comprising a top opening, a first transverse pivot hole near one end, a second transverse pivot hole near an opposite end, and a third transverse pivot hole spaced between said first transverse pivot hole and said second transverse pivot hole;

a second pivot mounted in the third transverse hole of said handle;

a third pivot mounted in the second transverse pivot hole of said handle;

a fourth pivot mounted in the first transverse pivot hole of said handle and connected between the first upright lugs of said base frame;

a front push plate turned about said second pivot and retained between said handle and said base frame, said front push plate comprising a transverse push face at one end adapted for engaging the transverse teeth of said first strap, two upright side walls turned about said second pivot and bilaterally disposed outside two opposite sides of said handle, two backward lugs perpendicularly extending from said transverse push face and equally spaced between said upright side walls and turned about said second pivot;

a second torsional spring mounted around said second pivot between the backward lugs of said front push plate, having one end stopped against said front push plate and an opposite end stopped against said handle to impart a downward pressure to the push face of said front push plate;

a retainer plate turned about said third pivot below said handle, said retainer plate comprising a top recessed hole, a smoothly curved face at one end, a press knob at an opposite end projecting into the top opening of said handle and adapted for pressing by hand to turn said retainer plate about said third pivot, and two pawls at two opposite sides of said smoothly curved face and adapted for engaging the noses of said base frame respectively; and a third torsional spring mounted within the top recessed hole of said retainer plate, having one end stopped against said retainer plate and an opposite end stopped against said handle to impart a downward pressure to the smoothly curved face of said retainer plate, causing the pawls of said retainer plate to be forced into engagement with the noses of said base frame.

* * * * *